US005328174A

United States Patent [19]

Reeder

[11] Patent Number: 5,328,174

[45] Date of Patent: Jul. 12, 1994

[54] EXTENSIBLE GOLFING DEVICE AND BALL RETRIEVER

[76] Inventor: Robert P. Reeder, 1302 Barksdale Rd., Newark, Del. 19711

[21] Appl. No.: 69,437

[22] Filed: Jun. 1, 1993

[51] Int. Cl.[5] ..... A63B 53/12; A63B 53/16

[52] U.S. Cl. ..... 273/162 E; 273/81.2; 273/80.7

[58] Field of Search ..... 273/162 E, 81.2, 165, 273/81 R, 81 C, 80.7, 80 D

[56] References Cited

U.S. PATENT DOCUMENTS

| | | | |
|---|---|---|---|
| 1,830,520 | 11/1931 | Moyses | 273/162 E X |
| 3,102,726 | 9/1963 | Barrett | 273/81.2 |
| 3,424,464 | 1/1969 | Greenhouse | 273/178 |
| 3,528,660 | 9/1970 | Kategian | 273/80 |
| 3,840,231 | 10/1974 | Moore | 237/79 |
| 4,361,329 | 11/1982 | Brock | 273/162 |
| 4,429,875 | 2/1984 | Stanton | 273/81.2 |
| 5,024,438 | 6/1991 | Candow | 273/81 |
| 5,029,860 | 7/1991 | Ehrich | 273/81.2 |

*Primary Examiner*—George J. Marlo
*Attorney, Agent, or Firm*—Rhodes & Ascolillo

[57] ABSTRACT

An extendible shaft apparatus for golf clubs has a shaft of a golf club slidingly enclosed within a tubular handle member. A gripping means, on one end of the tubular handle member, releasably grips the shaft of the golf club. The gripping means has a threaded male locking member, at least two first apertures, in the male locking member that form at least two flexible first finger members. A threaded female locking member adjustably, threadingly and releasingly engages with the male locking member. At least one shaft guide and alignment bushing has an outside surface intimately engaging an inner wall of the tubular handle member and an inside surface slidingly engaging the shaft of the golf club. The threaded female locking member has a textured gripping surface on an outer wall. There may be a golf ball retrieving head on another end of the tubular handle member releasably grips a golf ball. The golf ball retrieving head has a base member. At least two second apertures, in the base member, form at least two second flexible finger members. A base member locking protrusion releasingly locks the base member to the end of the tubular handle member.

5 Claims, 4 Drawing Sheets

EXTENSIBLE GOLFING DEVICE AND BALL RETRIEVER

BACKGROUND OF THE INVENTION

1. Field of the Invention

This invention relates to an Extendible Shaft Apparatus for a Golf Club that can be placed on the shafts of most golf clubs and extends the shaft length of the club thereby allowing the golfer to lengthen his or her stroke for all golf clubs except the putter. The extendible shaft apparatus, when placed on the shaft of the putter, will allow the player to accomplish a stance that will be a more natural, upright position. The invention may include a golf ball retrieving apparatus (most particularly on the putters) that enables the golfer to retrieve a golf ball from hard-to-reach places such as water hazards and allows golfers with back problems to retrieve their balls without bending at the waist by utilizing the extendible shaft.

2. Description of the Related Art

Golfers often desire to increase the stroke of their clubs for comfort, accuracy and convenience. Many golfers find it difficult to address a golf ball due to either the location of the ball or a physical malady the golfer suffers such as difficulty in bending over. Several devices have been suggested to the golfing public to try to remedy this problem. These devices accomplish this in several ways. However, none of these allow the golfer not only to extend the shaft length of his clubs but to also retrieve his ball utilizing the extendible shaft apparatus.

U.S. Pat. No. 4,361,329 to J. A. Brock on Nov. 30, 1982 for a Putting Club Including Ball Pick Up Device shows a putter having a head member with a scoop-like receptacle on the toe end of the putter head to hold a golf ball.

U.S. Pat. No. 3,424,464 to D. Greenhouse on Jan. 28, 1969 for a Golf Practice Apparatus describes a novelty golf putter having an extensible shaft that allows the putter to be placed on a desk via an ashtray mount. The tubes appear to frictionally slide on a connecting tube in the same manner as the tubes of an inexpensive telescope.

U.S. Pat. No. 3,528,660 to N. C. Kategian on Sep. 15, 1970 for a Collapsible Golf Shaft shows a shaft whose sections are tapered to allow the sections to frictionally and releasingly lock together when snapped to full extension.

U.S. Pat. No. 3,840,231 to D. D. Moore on Oct. 8, 1974 for a Golf Club Having Adjustable Head Means describes a collapsible shank having frictional engagement between the members and having compartmented serrations on the members to avoid rotational movement of one member in respect to another member.

U.S. Pat. No. 5,024,438 to A. J. Candow on Jan. 18, 1991 for a Detachable Golf Putter Extension shows a device for increasing the shaft length of a putter. An anchoring device is firmly placed within the original shaft. A male portion of the extension may be removably inserted within a female receptacle of the anchor when a longer stroke is desired or removed when a stroke as provided by the original shaft is needed.

U.S. Pat. No. 5,029,860 to J. D. Ehrich on Jul. 9, 1991 for a Collapsible Golf Club describes a telescopically connected tubular shaft threadingly secured in an extended position.

The present invention allows the golfer to accomplish multiple shaft lengths by the process of retrofitting said invention to any and all desired clubs. By utilizing the retrieving apparatus, the extended shaft of the club can be used to retrieve a golf ball. This invention does not alter the club head in any manner as is taught in some previous devices. This allows the golfer to maintain the trusted interface between the club head and the ball.

SUMMARY OF THE INVENTION

The present invention is designed to be installed over a conventional golf club shaft. One of its uses is to extend the length of the shaft to increase the club head speed at the contact point with the golf ball. The golfer may elect to extend the length of a putter shaft thus allowing the player to accomplish the stroke in a more natural, upright position. The extendible shaft apparatus may be used with the golf ball retriever (especially on the putters) to retrieve a golf ball from the bottom of a water hazard, a rough or from a cup. The exterior surface of the tubular handle may be coated with a material, such as a rubber or the like, to enhance a grip on the handle. Nearly all of the parts of the extendible shaft apparatus may be made of plastic or if desired it may be made of metal or a combination of both. Once the grip on the club shaft has been removed, the gripping position of the extendible shaft apparatus on the shaft of the club may be adjusted to grip nearly anywhere along the length of the shaft of the club.

This allows the user to extend the club to accommodate numerous shaft length positions. The extendible feature also allows the retrieval of the ball from deep water. The extendible shaft apparatus may be easily removed from the golf club by loosening the gripping means, removing the female locking member from the male locking member and sliding the tubular handle from the shaft of the club. A hand grip may then be placed once more on the club shaft.

Hence, it can be seen that the shaft length can be adjusted with a simple twist and push-pull motion. A golfer can be afforded the advantages of a conventional length golf club or one with a longer handle. A putter may be used at the conventional length kept at the chest-high position or, by extending the extendible shaft apparatus, at a position that rests under the chin all in the same round. Putters having longer shafts are becoming increasingly popular especially among elderly golfers. The extendible shaft putters promote a steady, pendulum-like stroke and negate the tendency to "jerk" rotate the putter. With the Extendible Shaft Apparatus for Golf Clubs, the golfer does not need to buy a new golf club for each change in shaft length desired. In addition, one need only to invert the putter with the extendible shaft and, using the ball retriever, press the ball retriever over the ball after it has been holed in order to retrieve it.

An extendible shaft apparatus for golf clubs encloses a shaft of a golf club slidingly within a tubular handle member. There is a gripping means, on one end of the tubular handle member, to releasably grip the shaft of the golf club. At least one shaft guide and alignment bushing has an outside surface, that intimately engages an inner wall of the tubular handle member, and has an inside surface that slidingly engages the shaft of the golf club.

In another embodiment, an extendible shaft apparatus for golf clubs has a shaft of a golf club slidingly enclosed within a tubular handle member. There is a gripping means, on one end of the tubular handle member to releasably grip the shaft of the golf club, that has a male locking member, at least two first apertures in the male locking member that form at least two flexible first finger members and a female locking member that is adjustably and releasingly engaged with the male locking member. There is at least one shaft guide and alignment bushing that has an outside surface that intimately engages an inner wall of the tubular handle member and an inside surface that slidingly engages the shaft of the golf club. The extendible shaft apparatus for golf clubs may have a golf ball retrieving head, on another end of the tubular handle member, to releasably grip a golf ball.

It is an object of this invention to provide an extendible shaft apparatus for golf clubs that allows a golfer to extend the length of a shaft of a golf in order to lengthen the stroke applied to the golf ball.

It is another object of this invention to allow the player to complete the putting task in a more natural, upright position.

It is another object of this invention to provide an extendible shaft apparatus for golf clubs that allows the user to attach a golf ball retrieving apparatus to one end of the extendible shaft apparatus, extend the handle (if required) and retrieve difficult to reach golf balls.

DESCRIPTION OF THE PREFERRED EMBODIMENTS

Figure 1:
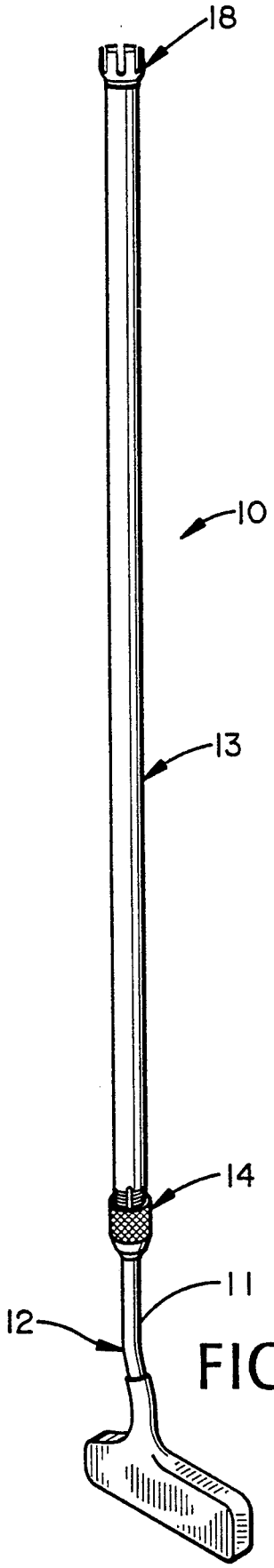
FIG. 1 is a perspective view of an Extendible Shaft Apparatus for Golf Clubs shown attached to a golf club.
Figure 2:
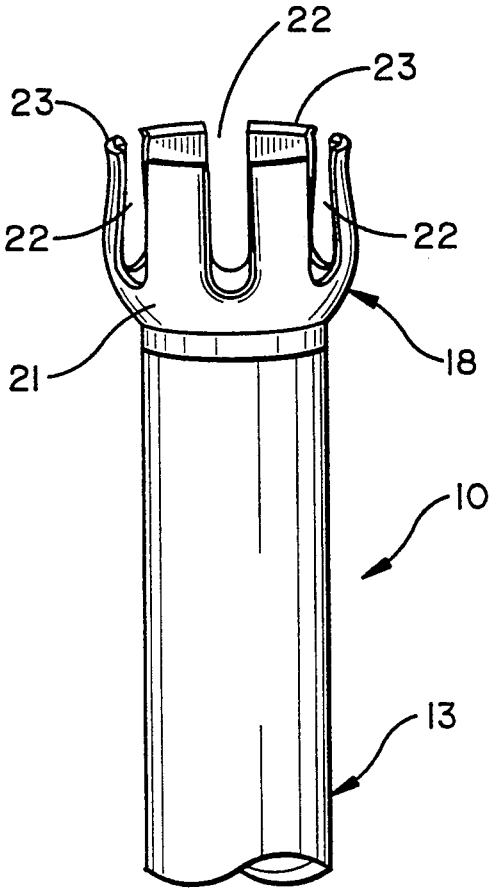
FIG. 2 is a enlarged partial elevational view showing the golf ball receiving head.
Figure 3:
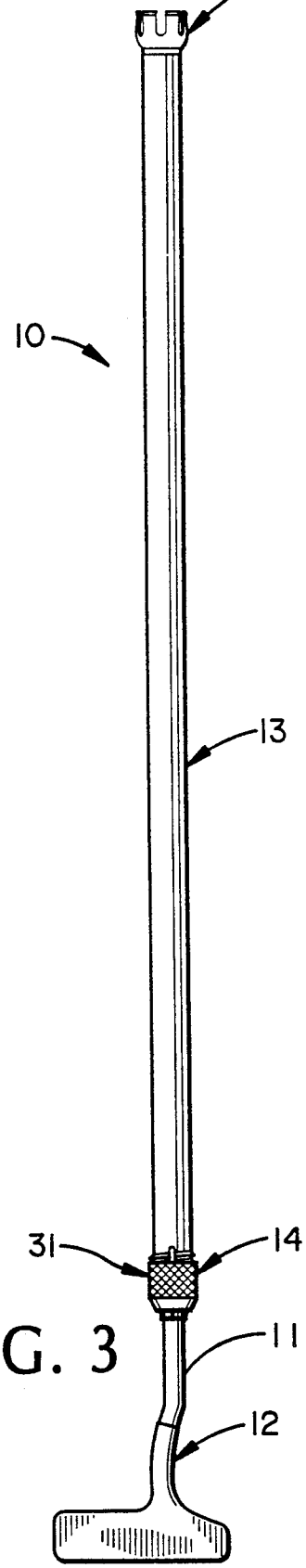
FIG. 3 is a right side elevational view of the Extendible Shaft Apparatus for Golf Clubs shown attached to a golf club.
Figure 4:
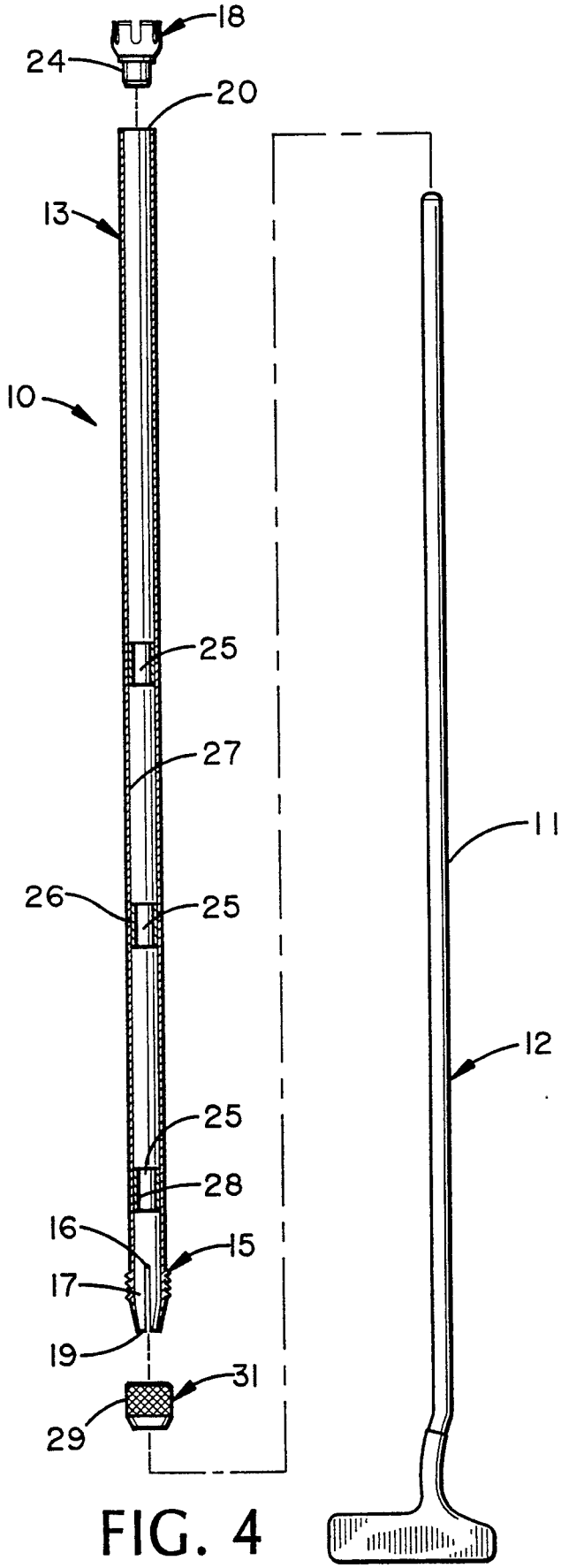
FIG. 4 is an exploded left side elevational view show the Extendible Shaft Apparatus for Golf Clubs removed from a shaft of a golf club.
Figure 5:
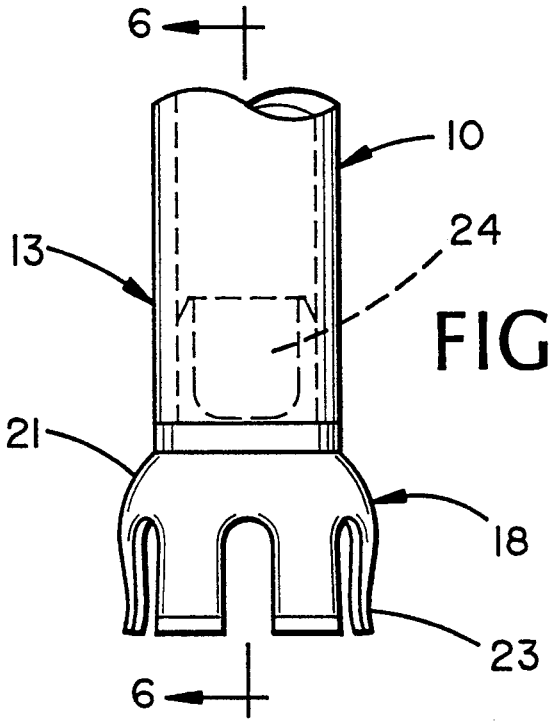
FIG. 5 is an enlarged partial elevational showing, by hidden lines, the base member locking protrusion within the end of the tubular handle member.
Figure 6:
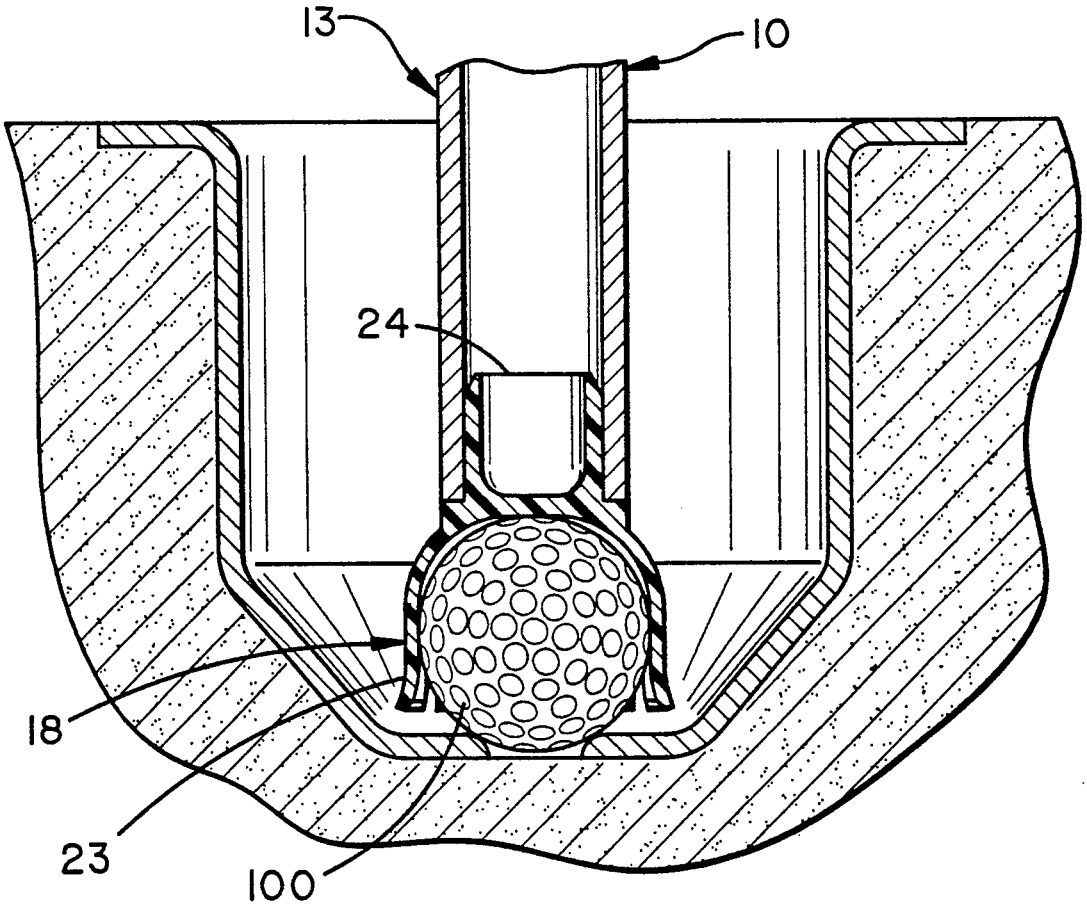
FIG. 6 is a partial cross-sectional view of the Extendible Shaft Apparatus for Golf Clubs, taken along line 6—6, placed within a partial cross-sectional view of a golf ball hole to illustrate a golf ball being retrieved from the hole.
Figure 9:
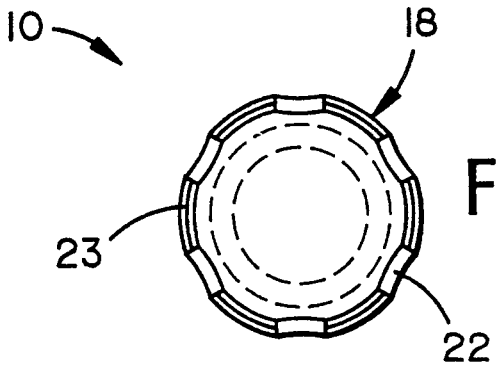
FIG. 9 is a top plan view of FIG. 7.
Figure 7:
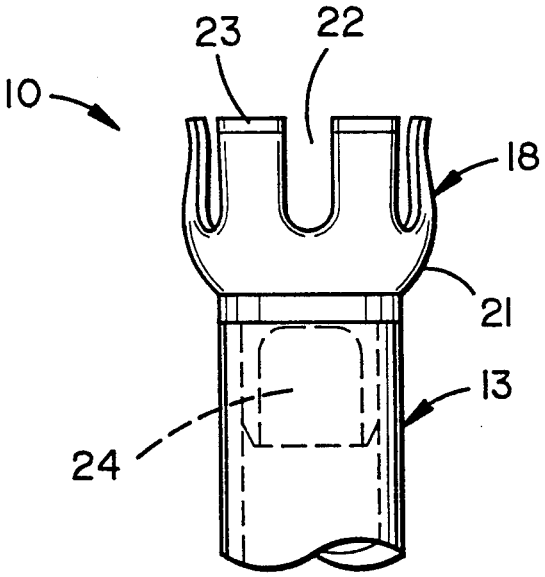
FIG. 7 is an enlarged partial elevational showing, by hidden lines, the base member locking protrusion within the end of the tubular handle member.
Figure 8:
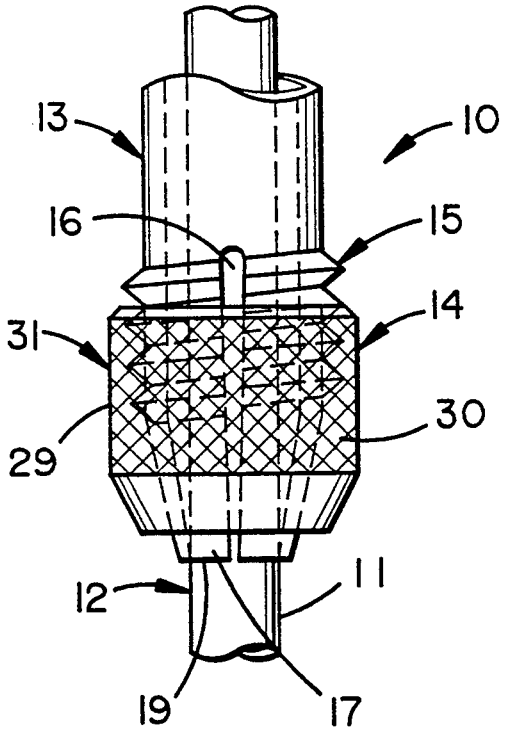
FIG. 8 is an enlarged partial view showing the gripping means that grips the shaft of the golf club. The hidden lines show the male locking member within the female locking member. The textured gripping surface is also shown.

Referring to FIGS. 1 through 9, an Extendible Shaft Apparatus 10 for Golf Clubs 12 is shown. A shaft 11 of a golf club 12 is slidingly enclosed within a tubular handle member 13. There is a gripping means 14, on one end 19 of the tubular handle member 13 to releasably grip the shaft 11 of the golf club 12, that has a threaded male locking member 15. The gripping means 14, shown in FIG. 8, also has at least two first apertures 16 in the male locking member 15. The apertures 16 form at least two flexible first finger members 17. A threaded female locking member 29 is adjustably, threadingly and releasingly engaged with the male locking member 15. There is a golf ball retrieving head 18; on another end 20 of the tubular handle member 13, to releasably grip a golf ball 100. The golf ball retrieving head 18 has a base member 21. There are at least two second apertures 22 in the base member 21 that form at least two second flexible finger members 23. A base member locking protrusion 24 is attached to the base member 21 to releasingly lock the base member 21 to the end of the tubular handle member 13. There is at least one shaft guide and alignment bushing 25 having an outside surface 26 that intimately engages an inner wall 27 of the tubular handle member 13. Bushing 25 has an inside surface 28 that slidingly engages the shaft 11 of the golf club 12. The threaded female locking member 29 has a textured gripping surface 29 on an outer wall 30.

The foregoing descriptions and drawings of the invention are explanatory and illustrative only, and various changes in shape, sizes and arrangements of parts as well certain details of the illustrated construction may be made within the scope of the appended claims without departing from the true spirit of the invention.

I claim:

1. An extendible shaft apparatus for golf clubs comprising:

(a) a shaft of a golf club slidingly enclosed within a tubular handle member;

(b) a gripping means, on one end of the tubular handle member, to releasably grip the shaft of the golf club; and (c) at least one shaft guide and alignment bushing having an outside surface, intimately engaging an inner wall of the tubular handle member, and an inside surface slidingly engaging the shaft of the golf club.

2. An extendible shaft apparatus for golf clubs comprising:

(a) a shaft of a golf club slidingly enclosed within a tubular handle member;

(b) a gripping means, on one end of the tubular handle member, to releasably grip the shaft of the golf club comprising:

a male locking member;

at least two first apertures, in the male locking member, forming at least two flexible first finger members; and a female locking member adjustably and releasingly engaged with the male locking member; and (c) at least one shaft guide and alignment bushing having an outside surface, intimately engaging an inner wall of the tubular handle member, and an inside surface slidingly engaging the shaft of the golf club.

3. An extendible shaft apparatus for golf clubs as described in claim 2 further comprising a golf ball retrieving head, on another end of the tubular handle member, to releasably grip a golf ball.

4. An extendible shaft apparatus for golf clubs comprising:

(a) a shaft of a golf club slidingly enclosed within a tubular handle member;

(b) a gripping means, on one end of the tubular handle member, to releasably grip the shaft of the golf club comprising:

a threaded male locking member;

at least two first apertures, in the male locking member, forming at least two flexible first finger members; and a threaded female locking member adjustably, threadingly and releasingly engaged with the male locking member;

(c) a golf ball retrieving head, on another end of the tubular handle member, to releasably grip a golf ball comprising:

a base member;

at least two second apertures, in the base member, forming at least two second flexible finger members; and a base member locking protrusion to releasingly lock the base member to the end of the tubular handle member; and (d) at least one shaft guide and alignment bushing having an outside surface, intimately engaging an inner wall of the tubular handle member, and an inside surface slidingly engaging the shaft of the golf club.

5. An extendible shaft apparatus for golf clubs as described in claim 4 wherein the threaded female locking member has a textured gripping surface on an outer wall.

* * * * *